US005613249A

United States Patent [19]

Ito

[11] Patent Number: 5,613,249

[45] Date of Patent: Mar. 25, 1997

[54] DEVICE FOR ADJUSTING THE WAIST SIZE OF A GARMENT

[76] Inventor: Yutaka Ito, No. 3-11, Nakagawa 5 chome, Ikuno-ku, Osaka-shi, Osaka-fu, Japan

[21] Appl. No.: 495,910

[22] Filed: Jun. 28, 1995

Related U.S. Application Data

[63] Continuation of Ser. No. 301,563, Sep. 7, 1994, abandoned.

[30] Foreign Application Priority Data

Sep. 10, 1993 [JP] Japan ..... 49331 U

[51] Int. Cl.[6] ..... A44B 19/00

[52] U.S. Cl. ..... 2/235; 24/585; 2/237; 2/338; 2/221

[58] Field of Search ..... 2/235, 236, 237, 2/311, 319, 322, 323, 324, 336, 338, 269, 270, 219, 220, 221; 24/585, 68 R, 652, 656, 687, 691, 696

[56] References Cited

U.S. PATENT DOCUMENTS

| | | | |
|---|---|---|---|
| 4,133,082 | 1/1979 | Kanzaka | 24/68 |
| 4,945,616 | 8/1990 | Okano | 24/585 |
| 5,181,300 | 1/1993 | Schwarz | 24/585 |

*Primary Examiner*—C. D. Crowder
*Assistant Examiner*—Shirra L. Jenkins
*Attorney, Agent, or Firm*—Armstrong, Westerman, Hattori, McLeland & Naughton

[57] ABSTRACT

A device for adjusting the waist size of a garment having an inner waist portion and an outer waist portion which are loose and can be held together in a mutually overlapping relation, includes a guide tape attached to the outside of the inner waist portion and having a plurality of teeth formed on its inner surface along its length, and a slider attached to the outer waist portion slidably along the guide tape and engageably with its teeth. The slider includes a flat hollow body having a pair of horizontally spaced apart openings through which the guide tape extends, and a pair of vertically spaced apart openings, and an actuator housed in the body and having a push head at its top, a leg at its bottom and a plurality of protrusions each engageable with one of the teeth on the guide tape. The head and leg are held in the vertically spaced apart openings, respectively, of the body. The body is secured to the outer waist portion of the garment by a fitting having prongs pierced therethrough. At least one spring is housed in the body for urging the actuator upwardly to hold the protrusions in engagement with some of the teeth on the guide tape to hold the slider against movement along the guide tape until the push head is depressed to push down the actuator to disengage the protrusions from the teeth and render the slider slidable along the guide tape.

4 Claims, 3 Drawing Sheets

DEVICE FOR ADJUSTING THE WAIST SIZE OF A GARMENT

This application is a continuation in application Ser. No. 08/301,563 filed Sep. 7, 1994, now abandoned.

BACKGROUND OF THE INVENTION

1. Field of the Invention

This invention relates to a device for adjusting the waist size of a garment by changing the positions of its overlapping portions fastened together around the waist, or body of a person wearing it.

2. Description of the Prior Art

Known devices for adjusting the waist size of a garment are disclosed in Japanese Utility Model Applications "Kokai" Nos. 1-62309 and 1-177228. The garment to which a device is attached, such as trousers or a skirt, has an outer waist portion and an inner waist portion which overlap each other and define the top border of a pocket which is provided at one or each side of the garment and open at the top, as well as at the side. The device includes a guide rail attached to the outer surface of the inner waist portion of the garment and having a row of projections, and a slider attached to the outer waist portion engageably with those projections and movably along the guide rail for adjusting the waist size of the garment.

The known devices are, however, complicated in construction as they are composed of a large number of parts, and are, therefore, difficult to assemble. They have a large thickness which makes a person wearing them feel awkward around the waist. They are not very easy to use, since it is necessary to press the device across its thickness, and it is, therefore, necessary to insert a finger between the device and the waist and hold the device between fingers.

SUMMARY OF THE INVENTION

It is, therefore, an object of this invention to provide a device which is simple in construction, and easy to assemble, has a small thickness, and is easy to use for adjusting the waist size of a garment.

This object is attained by a device for adjusting the waist size of a garment having an inner waist portion and an outer waist portion which are loose and can be held together in a mutually overlapping relation, the device comprising a guide tape for attachment to the outer surface of the inner waist portion of the garment and having a plurality of teeth formed on its inner surface along its length, and a slider for attachment to the outer waist portion of the garment and slidable along the guide tape and engageable with its teeth, the slider comprising a flat hollow body having a pair of horizontally spaced apart openings through which the guide tape extends, and a pair of vertically spaced apart openings, an actuator housed in the body and having a push head at its top, a leg at its bottom and a plurality of protrusions each engageable with one of the teeth on the guide tape, the push head and leg being held in the vertically spaced apart openings, respectively, of the body. A fitting is provided for securing the body to the outer waist portion of the garment, and a spring is housed in the body for urging the actuator upwardly to hold the protrusions in engagement with the teeth to hold the slider against movement along the guide tape until the push head is depressed to push down the actuator to disengage the protrusions from the teeth and render the slider slidable along the guide tape.

When it is necessary to vary the waist size of the garment equipped with the device of this invention, the actuator of the slider is pushed down by overcoming the force of the spring to disengage the protrusions from the teeth and render the slider slidable along the guide tape. If the actuator is released from pressure after the slider has been moved to an appropriate position, it is urged back by the spring to restore the engagement of the protrusions with the teeth and hold the slider against movement.

The device of this invention is simple in construction, and easy to assemble, as it is composed of only a small number of parts. It has a sufficiently small thickness not to make anybody wearing it on his garment feel awkward around his waist. Moreover, the device is easy to use, since it is no longer necessary to insert any finger between the device and the waist and hold the device between fingers, but it is sufficient to simply push down the actuator of the slider.

DETAILED DESCRIPTION OF THE INVENTION

A device embodying this invention is shown in FIGS. 1 to 3 and 6. It comprises a guide tape T and a slider S which is movable along the guide tape T for adjusting the waist size of a garment to which the device is attached.

Figure 1:
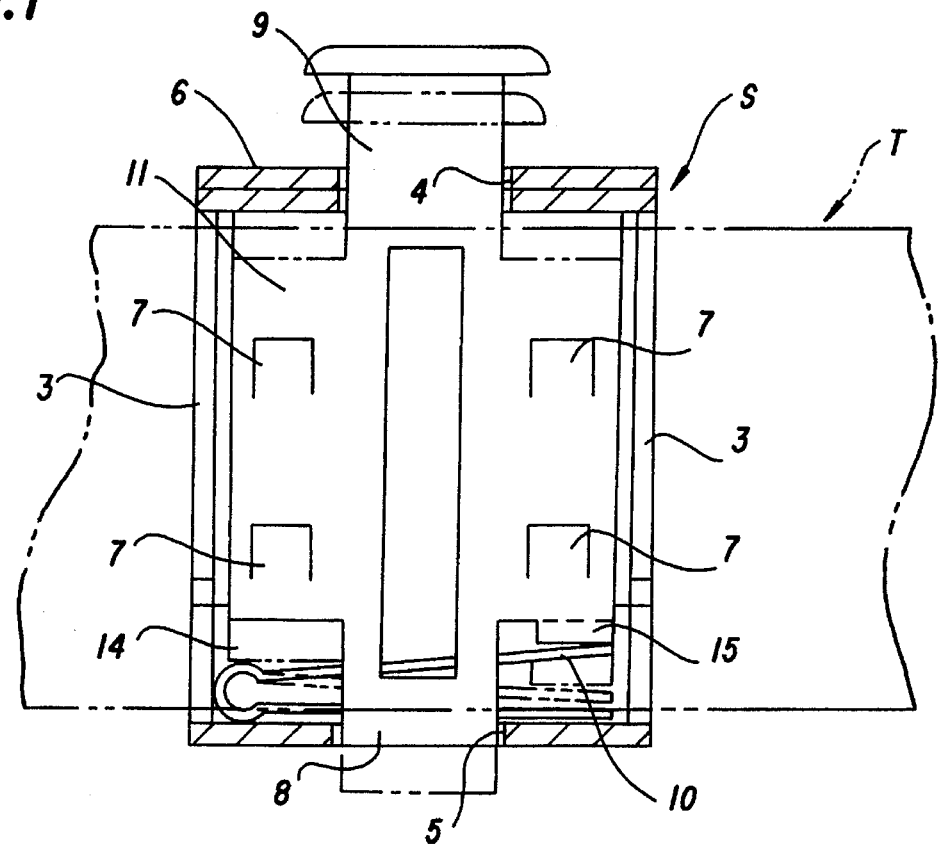
FIG. 1 is a front elevational view, partly in section, of a slider for a device embodying this invention.
Figure 2:
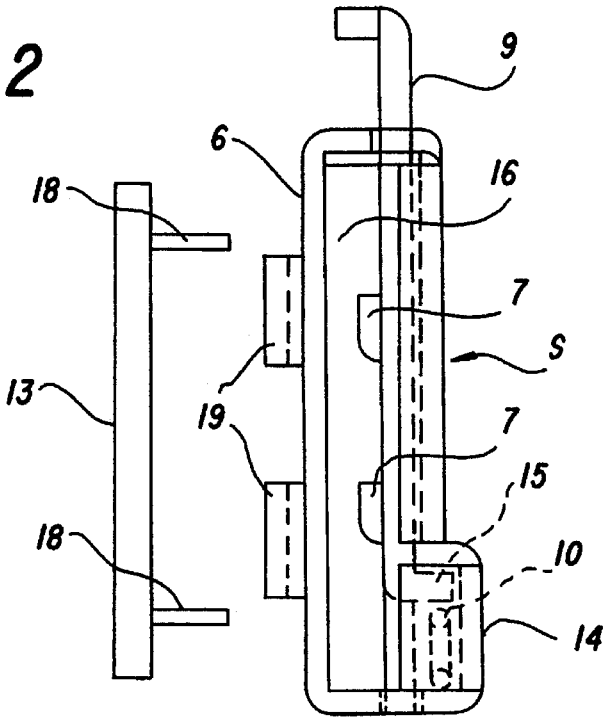
FIG. 2 is a right side elevational view of the slider of FIG. 1.
Figure 3:
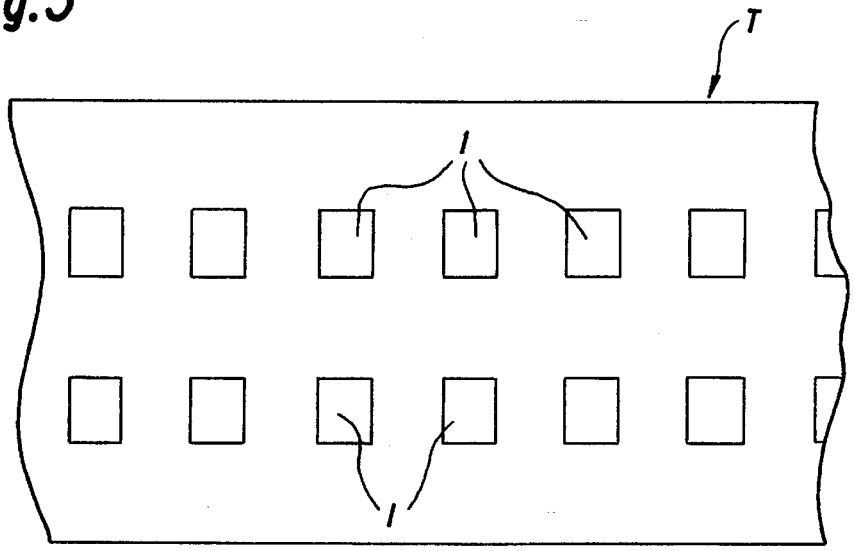
FIG. 3 is a fragmentary front elevational view of the guide tape for use in the device embodying this invention.
Figure 6:
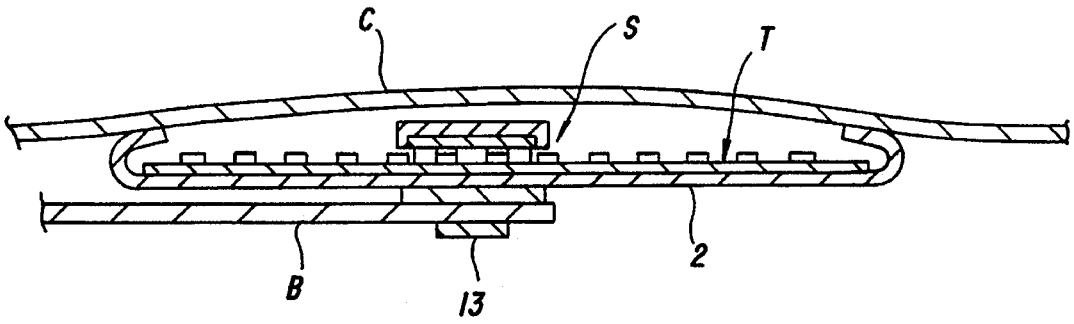
FIG. 6 is an enlarged sectional view taken along the line A—A of FIG. 7.

The guide tape T is formed from a synthetic resin, and has two rows of equally spaced apart teeth 1 formed on one side thereof along its length, as shown in FIG. 3, while the other side thereof is bonded to a strip of cloth 2 attached to the garment by sewing, as shown in FIG. 6.

The slider S comprises a relatively flat hollow body 6, an actuator 11, a spring 10 shaped like a hairpin, and a fitting 13 for securing the body 6 to the garment, as will be described in further detail. The body 6 has a pair of horizontally spaced-apart first openings 3 through which the guide tape T can be passed, and a pair of vertically spaced apart second openings 4 and 5 formed at its top and bottom, respectively. The body 6 defines at its bottom a spring housing 14 recessed from a vertical plane in which the actuator 11 is movable, as will hereinafter be described. The spring housing 14 houses the spring 10. The body 6 has a front wall provided with a pair of lugs 19 on its central portion, while the fitting 13 has a pair of prongs 18 which can pierce the garment and be offset into the lugs 19, respectively, to secure the body 6 to the garment, as will be described in further detail.

The actuator 11 has a plurality of protrusions 7 formed on one side thereof each engageable with one of the teeth 1 on the guide tape T. The actuator 11 also has a leg 8 at its bottom, a spring holder 15 adjoining the leg 8 and bent into the spring housing 14, and a push head 9 at the center of its top.

The front wall of the body 6 can be opened when the slider S is assembled. The spring 10 is placed in the spring housing 14, and the actuator 11 is so positioned in the body 6 that its leg 8 may be held in the bottom opening 5 of the body 6, and its push head 9 in the top opening 4 thereof, while one end of the spring 10 is engaged with the spring holder 15, whereafter the body 6 is closed at its front wall to define an internal space 16 through which the guide tape T is passed.

Figure 4:
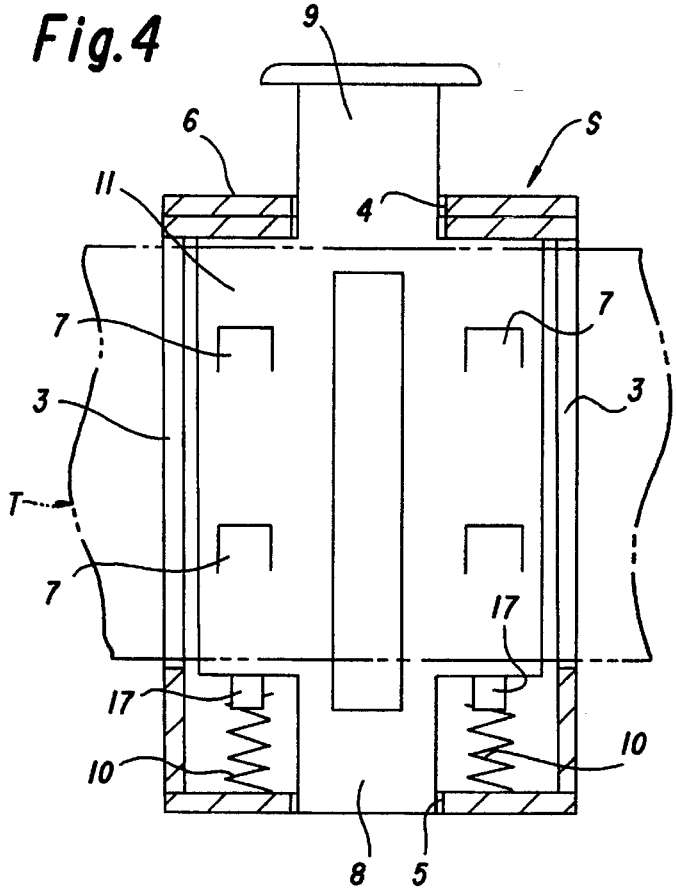
FIG. 4 is a view similar to FIG. 1, but showing a modified form of the slider.
Figure 5:
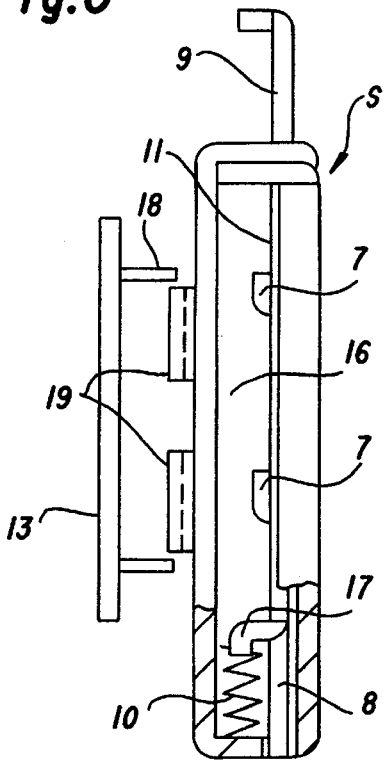
FIG. 5 is a view similar to FIG. 2, but showing the slider shown in FIG. 4.

While the body 6 has been shown and described as defining a special housing 14 for the spring 10 shaped like a hairpin, a modified form of slider S is shown in FIGS. 4 and 5. The modified slider has no special spring housing, but the actuator 11 is provided at its bottom on both sides of the leg 8 with a pair of inwardly and downwardly projecting L-shaped spring holders 17 which support a pair of coiled springs 10, respectively, located immediately below the internal space 16 of the body 6. Although the slider S shown in FIG. 4 has two springs 10 as described, it may sometimes be sufficient to employ only one spring.

Figure 7:
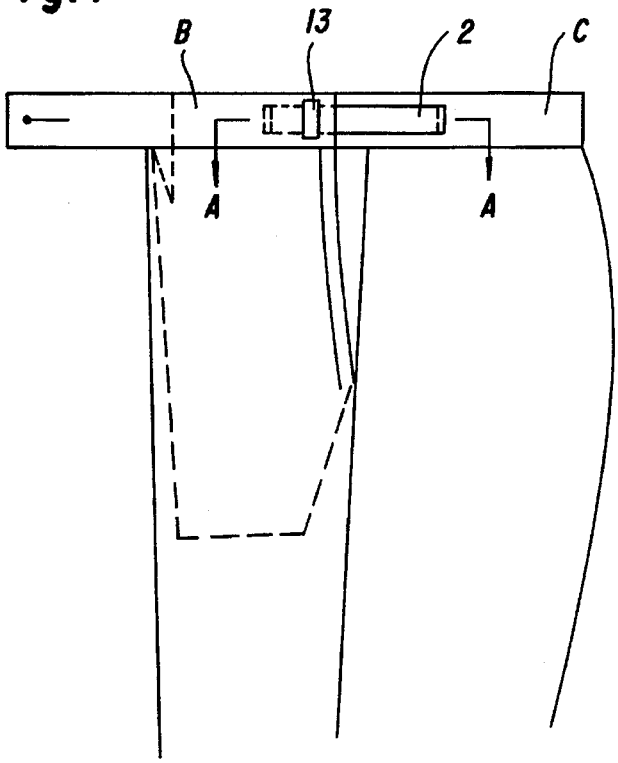
FIG. 7 is a schematic side elevational view of trousers provided with a device embodying this invention.

Beltless trousers, or a skirt, is a typical garment to which the device of this invention is effectively applicable. FIGS. 6 and 7 show the device attached to trousers having an inner waist portion C and an outer waist portion B. The guide tape T is passed through the slider S, and secured to the outer surface of the inner waist portion C of the trousers by sewing at both ends of the cloth 2 so that the teeth 1 may face the inner waist portion C. The slider S is held against the inner surface of the outer waist portion B of the trousers, and the prongs 18 of the fitting 13 are pierced through the outer waist portion B into the lugs 19, whereby the device is attached to the trousers.

The protrusions 7 on the actuator 11 of the slider S are normally engaged with some of the teeth 1 on the guide tape T. If it is necessary or desirable to vary the waist size of the garment, the push head 9 is depressed to push down the actuator 11 by overcoming the force of the spring (or springs) 10, so that the protrusions 7 may be disengaged from the teeth 1 to allow the slider S to slide along the guide tape T. After the slider S has been moved to an appropriate position, the actuator 11 is released from pressure, whereupon it is urged by the spring 10 to return to its raised position and restore the engagement of its protrusions 7 with some of the teeth 1 to hold the slider S in position.

What is claimed is:

1. A device for adjusting the waist size of a garment having an inner waist portion and an outer waist portion which are loose and can be held together in a mutually overlapping relation, said device comprising:

a guide tape for attachment to an outer surface of said inner waist portion of said garment and having a plurality of teeth formed on its inner surface along the length thereof; and a slider attachable to said outer waist portion of said garment, said slider being slidable along said guide tape and engageable with said teeth thereon, said slider comprising:

a flat hollow body having substantially rectangularly disposed sides, a pair of first openings disposed in horizontally spaced apart sides of said body through which said tape is adapted to extend, and a pair of second openings disposed in vertically spaced apart sides of said body;

an actuator housed in said body for movement therein, said actuator having a push head at its top, a leg at its bottom, and a plurality of protrusions, each engageable with one of said teeth on said guide tape, said head and said leg being retained in said vertically spaced apart second openings, respectively, to guide the movement of said actuator in a vertical direction;

a fitting engageable with said body for securing said body to said outer waist portion of said garment; and at least one spring housed in said body for urging said actuator upwardly to normally bias said protrusions on said actuator into engagement with some of said teeth on said guide tape to hold said slider against movement along said tape until said head is depressed against the force of said at least one spring to push said actuator downwardly to disengage said protrusions from said teeth and render said slider slidable along said tape.

2. A device as set forth in claim 1, wherein said teeth on said guide tape comprise two rows of equally spaced apart teeth formed in said guide tape, while said protrusions are so positioned on said actuator as to engage teeth in both of said rows.

3. A device as set forth in claim 1 or 2, wherein said spring is shaped-like a hairpin.

4. A device as set forth in claim 1 or 2, wherein said spring is a coiled spring.

* * * * *